US006186336B1

(12) United States Patent
Rohr

(10) Patent No.: US 6,186,336 B1
(45) Date of Patent: Feb. 13, 2001

(54) DREDGE WITH AUXILIARY GRIZZLY

(76) Inventor: Jochen Rohr, 140 Camino Don Miguel, Orinda, CA (US) 94563

( * ) Notice: Under 35 U.S.C. 154(b), the term of this patent shall be extended for 0 days.

(21) Appl. No.: 09/429,885

(22) Filed: Oct. 29, 1999

(51) Int. Cl.[7] ..... B07B 1/00
(52) U.S. Cl. ..... 209/233; 209/240
(58) Field of Search ..... 209/233, 234, 209/240, 385, 388

(56) References Cited

U.S. PATENT DOCUMENTS

| | | | |
|---|---|---|---|
| 784,584 | 3/1905 | Myers . | |
| 1,263,829 | 4/1918 | Wintersgill . | |
| 4,116,326 | 9/1978 | Tuman . | |
| 4,287,064 | 9/1981 | Ando et al. . | |
| 4,731,180 | 3/1988 | Huff . | |
| 4,792,394 | 12/1988 | Rudzinski . | |
| 5,072,991 | 12/1991 | Rohr . | |
| 5,427,251 | 6/1995 | Landmann et al. . | |
| 5,449,072 | 9/1995 | Braun et al. . | |
| 5,588,536 * | 12/1996 | Rohr | 209/385 |
| 6,059,120 * | 5/2000 | Rohr et al. | 209/428 |

* cited by examiner

*Primary Examiner*—Donald P. Walsh
*Assistant Examiner*—Mark J. Beauchaine
(74) *Attorney, Agent, or Firm*—Wood, Herron & Evans, L.L.P.

(57) ABSTRACT

A dredge includes a primary grizzly with a sieve for separating dredged material initially into recoverable and discharge portions. A second or auxiliary grizzly and sieve are also provided on a chute extending from the primary grizzly to further remove remaining recoverable material from the portion of material discharged from the primary grizzly. A gate is provided for selectively opening and closing access to the auxiliary grizzly depending upon the make-up of the material discharged from the top of the primary grizzly. The combination of the primary and auxiliary grizzly provide for increased efficiency and effectiveness in recovering a larger percentage of recoverable material from a water-based dredging operation.

13 Claims, 5 Drawing Sheets

DREDGE WITH AUXILIARY GRIZZLY

BACKGROUND OF THE INVENTION

This invention relates to dredges, and, more particularly, to grizzlies for such a dredge which separate recoverable material from material to be discharged or waste material.

Water-based and floating dredges typically include one or more bucket or clamshell-types grabs which are lowered into a waterway to collect sand, clay, gravel or the like from the bottom of the waterway. The grab typically deposits the collected material onto a grizzly which often includes a sieve having a plurality of generally parallel bars. The dredged material often contains components whose value justifies recovering them such as sand and gravel. Other components, such as clay, are not desirable for recovery and are simply collected for removal and disposal. Separating the recoverable material from the material to be discharged, however, in the past has been an inefficient and often time consuming process. Frequently, the dredged material includes a wide variety of materials. In other words, rarely does the dredged material include entirely recoverable material or entirely waste material to be discarded.

The time and expense involved in recovering useful material through a water-based dredging operation are very significant. Therefore, it is important to effectively and efficiently retain all of the available recoverable material from a given load. Currently, one common method for dredging is to deposit or dump the load of dredged material in the grab onto a primary grizzly for further processing. Once the dredged material is deposited onto the grizzly, smaller materials, such as sand and gravel, pass through the bars of the grizzly for recovery and further processing. The material remaining atop the grizzly is then discharged therefrom.

One manner of discharging the material remaining atop the grizzly is disclosed in U.S. Pat. No. 5,588,536 issued to the present inventor and hereby incorporated by reference in its entirety. In that patent, the dredge includes a bi-directional grizzly which includes a rake structure that can be operated in either of two opposite directions. If the material remaining atop the grizzly includes sufficient recoverable material for further processing, the rake is operated in a first direction to discharge that material directly into in a crusher or the like. However, if the material remaining atop the grizzly is not worthy of recovery, the rake is operated in a second opposite direction for discharge of the material down an inclined chute and onto a refuse barge, conveyor or the like.

However, the material remaining atop the primary grizzly often includes a mixed variety of components. For example, the remaining material may include larger rocks, gravel or the like which are too large to pass between the spaced bars of the primary grizzly but are still worthy of recovery for further processing. Nevertheless, the material remaining atop the primary grizzle often includes clay and/or other waste along with the recoverable components. The operator of the dredge then must decide whether to discard the entire contents of the material atop the primary grizzly or further process the waste material included therein in an effort to retain the available recoverable material. This dilemma often results in the discharge of a significant quantity of worthwhile recoverable material or processing of clay and other undesirable elements resulting in an inefficient and ineffective dredging operation.

SUMMARY OF THE INVENTION

A primary objective of this invention has been to provide an improved dredge and associated method which allows for the efficient and effective recovery of a larger percentage of the worthwhile recoverable material from a load of dredged material without the processing of waste material such as clay and the like. These and other objectives of the invention have been attained by a dredging station which includes a primary grizzly, as previously discussed in the background of this invention, for separating a load of material collected by the grab into a first recoverable portion which falls through the sieve of the primary grizzly and a first discharge portion which remains atop the sieve of the primary grizzly.

The primary or first grizzly includes a discharge mechanism for removing the discharge portion of the material remaining atop that sieve. In one embodiment, the discharge mechanism of the primary grizzly is a tipping grizzly in which one longitudinal end of the grizzly elevates relative to the opposite end so that the first discharge portion slides off of the grizzly and onto an inclined chute. One example of such a tipping grizzly is shown in U.S. Pat. No. 5,427,251, which is hereby incorporated by reference in its entirety. Alternatively, the discharge mechanism may comprise a rake or other arrangement as disclosed in U.S. Pat. No. 5,588,536.

The chute is inclined so that an upstream end is elevated relative to a downstream end. As the first discharge portion of material flows or falls down the chute, it encounters a second or auxiliary grizzly having a sieve which includes a number of generally parallel spaced bars for straining the first discharge portion of the material into a second recoverable portion of material and a second discharge portion. The second discharge portion of material remains atop the second grizzly on the chute and subsequently flows toward the downstream end of the chute and onto a barge, conveyor or the like for ultimate disposal. Advantageously, a crusher is positioned below the chute and in communication with the second grizzly for processing of the second recoverable portion of material which passes through the second grizzly and into a funnel connected to the crusher.

A movable gate is included on the chute for selectively opening and closing the second grizzly to permit or inhibit, respectively, access to the second grizzly as required depending upon the make-up of the first discharge portion of material discharged from the primary grizzly. Additionally, the sieve of the second grizzly includes a plurality of spaced bars which, in a present embodiment, are removable to provide for convenient access to the funnel and crusher therebelow for dislodging jams or other accumulations that may inhibit the flow of material.

As a result of this invention, material recovered from a waterway or the like can be more effectively and efficiently processed so that a higher percentage of recoverable material is retained and waste material such as clay or the like is ultimately discharged for disposal without being processed.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
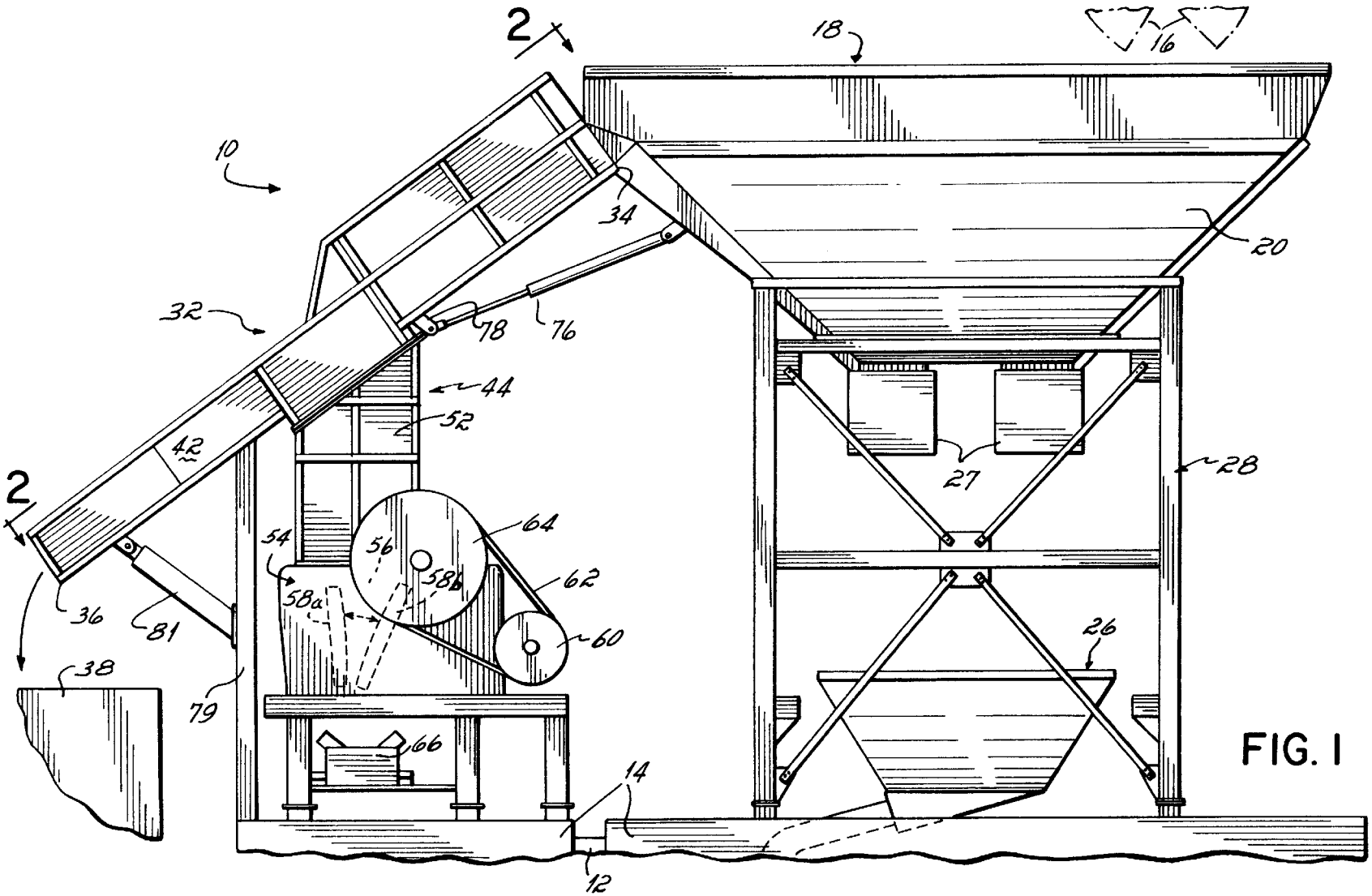
FIG. 1 is a side-elevational view of a dredge station including a chute and an auxiliary grizzly according to a presently preferred embodiment of this invention.

Referring to FIG. 1, a floating gantry-type dredge 10 for use in a waterway 12 according to a presently preferred embodiment of this invention is shown. The dredge 10 may include one or more pontoons 14 for floating support, but it should be understood that the present invention is not limited to a pontoon supported or catamaran-type dredge, but includes other suitable waterway or nonwater-based dredges. The dredge 10 according to this invention includes a clamshell-type grab 16 which is suspended from a gantry (not shown). The grab 16 is suspended from the gantry and is movable as is well known in the art to a position directly over a primary grizzly 18, as shown in FIG. 1, to a position (not shown) from which it is plunged into the waterway 12 for the collection and removal of sand, clay, gravel or the like from the bottom of the waterway 12.

The primary grizzly 18 includes a grizzly hopper 20 positioned immediately below a sieve 22 comprised of generally parallel-spaced bars 24 defining gaps 25 therebetween. The sieve 22 screens, filters or strains out large material and prevents it from falling into the hopper 20. The material that advances through the sieve 22 of the primary grizzly 18 and into the hopper 20 is directed to a material handling apparatus 27 and onto a conveyor 26 for further processing. The material which passes through the sieve 22 of the first grizzly 18 is referred to herein as a first recoverable portion. The dredge material which remains atop the sieve 22 of the first or primary grizzly 18 is referred to herein as the first discharge portion. The primary grizzly 18 and associated structure is supported by a support frame 28 extending between the grizzly 18 and the pontoon 14.

Figure 1A:
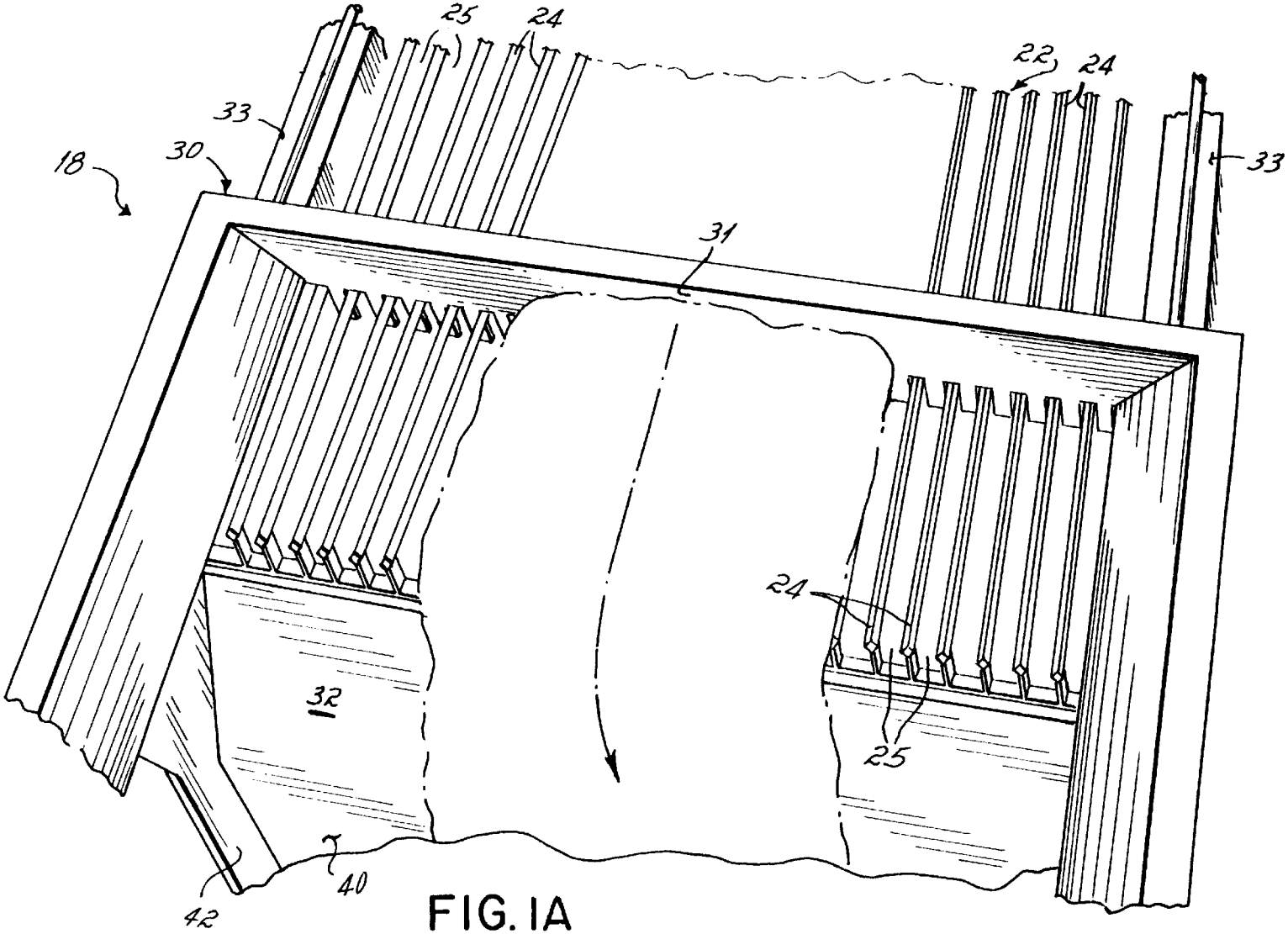
FIG. 1A is a top view of material being discharged from a primary grizzly shown in FIG. 1.

A discharge mechanism 30 as shown in FIG. 1A is provided for removing the first discharge portion from the sieve 22 of the first grizzly 18 and onto a chute 32. The discharge mechanism 30 may include a rake 31 and a tipping grid 33 such as that disclosed in U.S. Pat. No. 5,427,251 or may include a rake or other arrangement such as that disclosed in U.S. Pat. No. 5,588,536. Additionally, other arrangements for removing the first discharge portion from the sieve 22 of the primary grizzly 18 which are known to those of ordinary skill in the art are contemplated within the scope of this invention.

Figure 2:
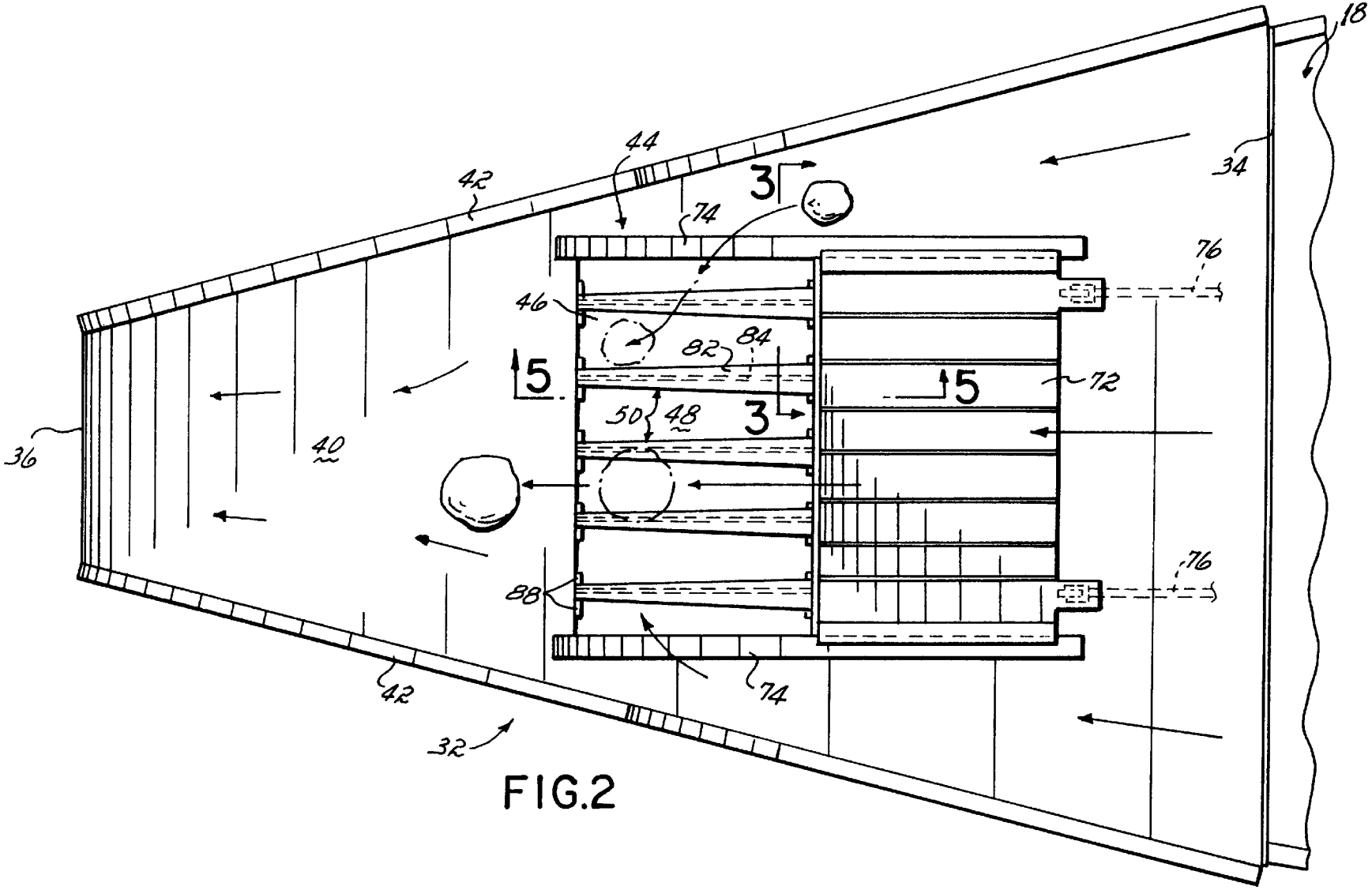
FIG. 2 is a cross-sectional top view of the chute and auxiliary grizzly taken along line 2—2 of FIG. 1.

The chute 32, which is particularly shown in FIGS. 1, 1A and 2, is inclined downwardly from an upstream end 34 toward a downstream end 36 thereof. At the downstream end 36 of the chute 32, waste, referred to herein as a second discharge portion, falls onto a refuse barge 38 or other receptacle docked or positioned adjacent to the dredge 10 for disposal. The chute 32 includes a generally planar bottom wall 40 and a pair of upstanding lateral sidewalls 42 for containing the material falling by gravity from the upstream end 34 to the downstream end 36. As shown particularly in FIG. 2, the chute 32 has a tapered configuration such that the upstream end 34 is wider than the downstream end 36. Preferably, the upstream end 34 of the chute 32 is approximately 4,350 mm in width and the downstream end 36 is approximately 1,234 mm in width and each sidewall 42 is approximately 6,348 mm in length.

Figure 5:
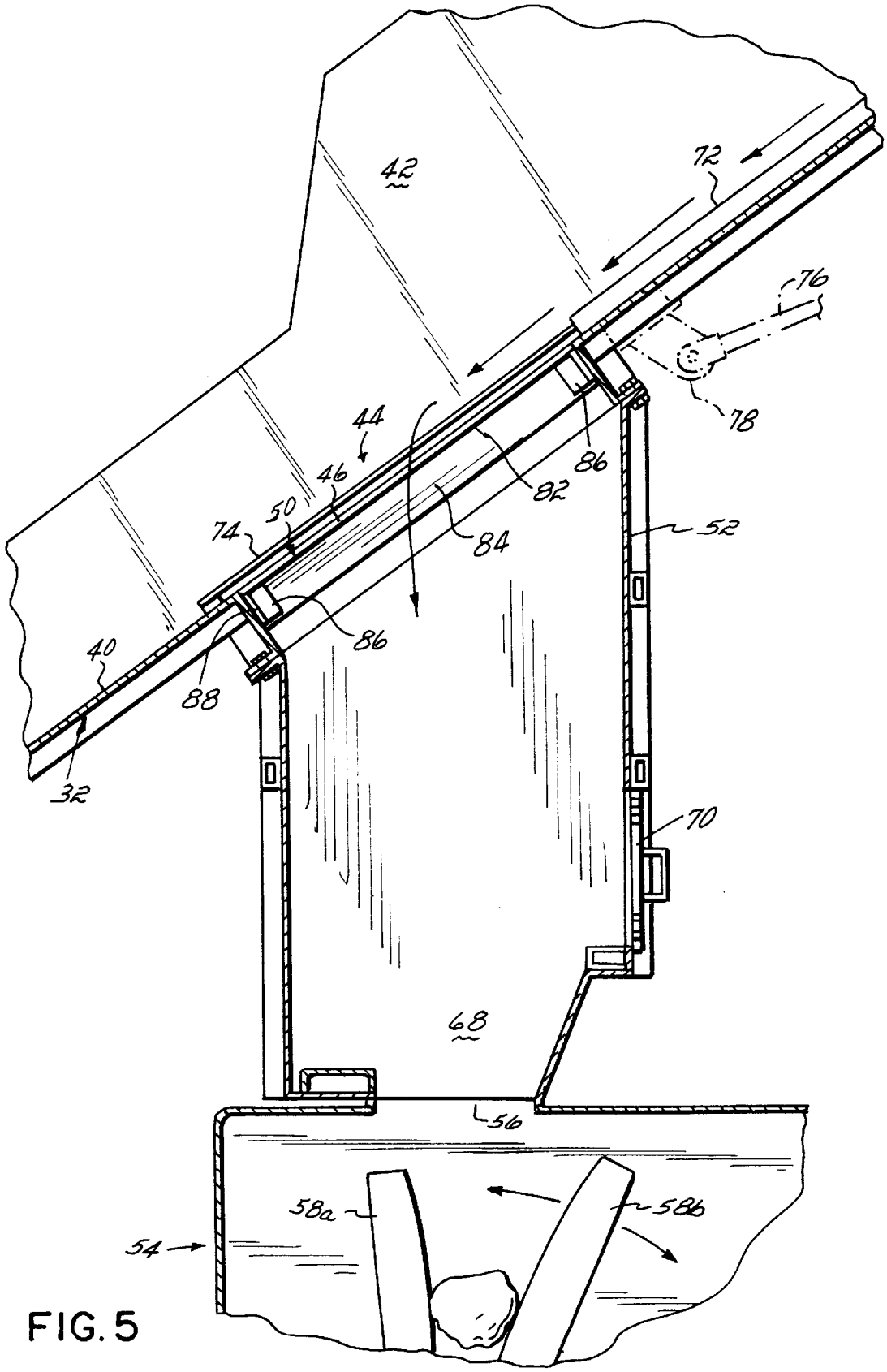
FIG. 5 is a cross-sectional view taken along line 5—5 of FIG. 2 showing a portion of the chute of the auxiliary grizzly, a funnel and a crusher in communication therewith.

Advantageously, the present invention includes a second or auxiliary grizzly 44 which in one embodiment is located on the chute 32, as shown particularly in FIGS. 1, 2 and 5. The second or auxiliary grizzly 44 has a second sieve 46 for straining the first discharge portion of material flowing from the upstream end 34 of the chute 32 towards the downstream end 36. The second sieve 46 strains the first discharge portion into a second recoverable portion which falls through gaps 48 formed between each pair of adjacent spaced bars 50 of the second grizzly 44. A second discharge portion remains atop the bars 50 of the second sieve 46.

The second recoverable portion falls through the second sieve 46 and a funnel 52 which in one embodiment projects downwardly from a bottom side of the chute 32 to direct the second recoverable portion of material into a crusher 54 located below the chute 32 and in communication with the second sieve 46. The second recoverable portion of material falls through the funnel 52 and into a mouth 56 of the crusher 54 and is crushed between a pair of opposing crusher jaw members 58*a*, 58*b*. In one embodiment, as is well known with crushers of this type, one jaw member 58*a* is stationary and an opposing jaw member 58*b* pivots toward and away from the stationary jaw member 58*a* to crush rocks, boulders or the like falling therebetween. The movable jaw member 58*b* is operably connected to a motor 60 and is driven via a belt 62 and a rotary drum 64, as seen in FIG. 1. A second recoverable portion of material which passes through the crusher 54 is then deposited onto a conveyor 66 for subsequent processing and the like.

An upper end of the funnel 52 is connected to the bottom of the chute 32 to receive the second recoverable portion of material falling through the second sieve 46. The funnel 52 includes a narrowed or tapered portion 68 at the bottom end thereof to direct the second recoverable portion of material into the crusher 54. In one embodiment, the funnel 52 includes a door 70 which can be selectively opened and closed to provide access to the funnel 52, the crusher 54 and adjacent components for servicing, replacement, cleaning or the like, as shown in FIG. 5.

Referring to FIGS. 1–3 and 5, this invention, in one embodiment, also includes a gate 72 to open and close the second grizzly 44 and to permit and inhibit, respectively, the flow of material through the second sieve 46. As shown in FIG. 2, the gate 72 includes a generally rectangular plate which is captured on opposing lateral ends thereof in a pair of spaced channels 74 for reciprocal movement between a retracted open position, as shown in FIG. 2, and an extended closed position (not shown). The gate 72 is coupled at an upper edge thereof to a pair of pneumatic cylinders 76 or the like for reciprocal movement of the gate 72 to and between the open and closed positions (FIGS. 1 and 2). Each cylinder 76 is pivotally coupled through a collar 78 to the gate 72, as shown in FIG. 5. Plastic, Teflon or other appropriate material strips 80 may be mounted in conjunction with the channels 74 to provide for the easy translation of the gate 72 between the open and closed positions.

As such, if the first discharge portion of material appears to contain nothing but waste, the operator may actuate the cylinders 76 to close the gate 72 and thereby prevent any material from falling through the sieve 46 of the second grizzly 44. As a result, all of the first discharge portion will then be dropped onto the waste barge 38 or the like for removal. Appropriate supporting beams 79 and braces 81 are required to support the chute 32 and the second auxiliary grizzly 44.

Figure 3:
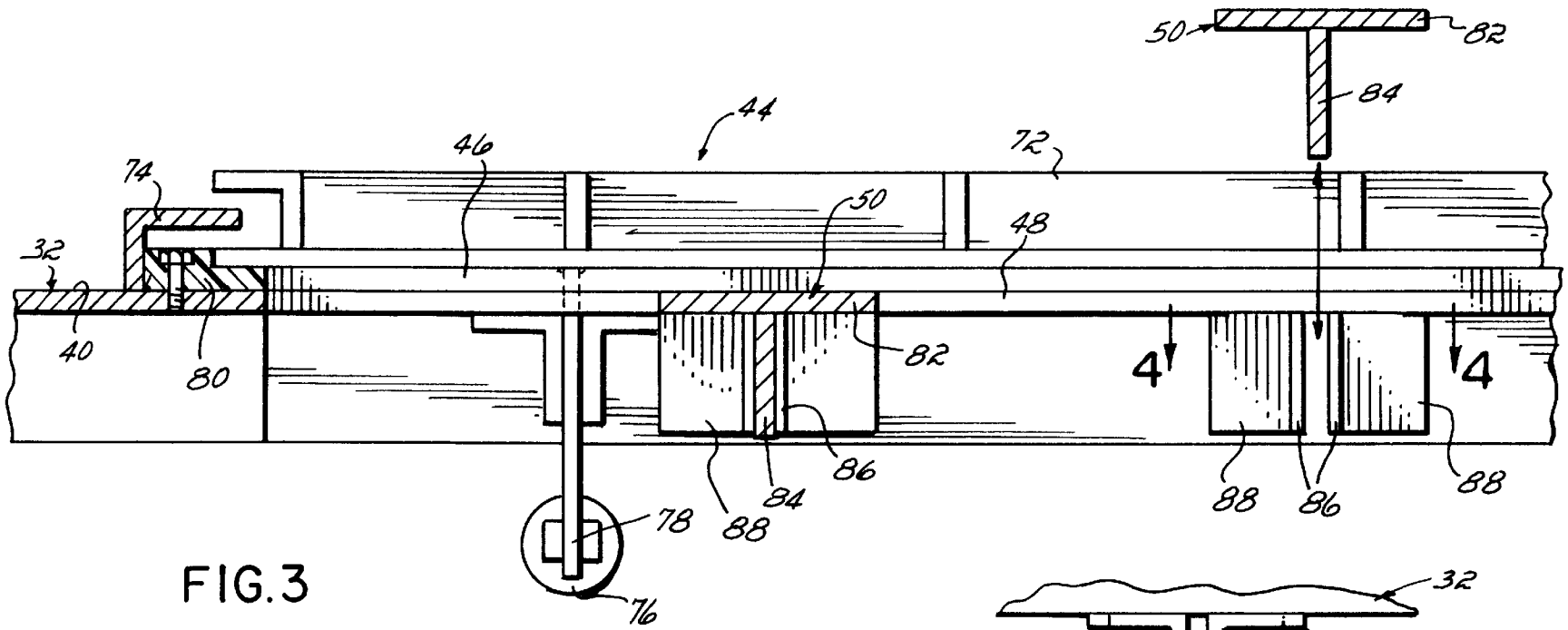
FIG. 3 is a cross-sectional view of a portion of the grizzly taken along line 3—3 of FIG. 2.
Figure 4:
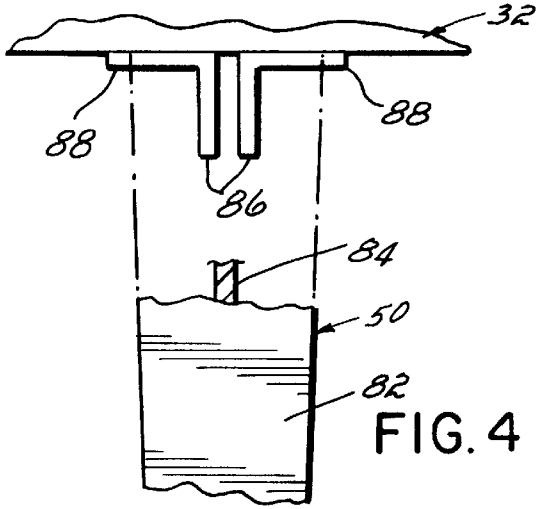
FIG. 4 is a cross-sectional view taken along line 4—4 of FIG. 3.

Referring to FIGS. 2–4, the second sieve 46 of the second grizzly 44 includes a plurality of spaced bars 50 which define the gaps 48 between each adjacent pair of bars 50. In one embodiment, the bars 50 are each selectively removable for repair, replacement and/or access to the funnel 52, crusher 54 and other structures positioned below the chute 32. Each bar 50 has a generally T-shaped cross-sectional configuration with an upper lateral member 82 and a downwardly extending lower member 84 forming the T-shaped configuration. In one embodiment, the width of the upper lateral member 82 of each T-shaped bar 50 is greater at an upstream end than at a downstream end, as shown in FIG. 2. As a result of the tapered configuration of the upper lateral member 82, the gap 48 provided between each pair of adjacent bars 50 is tapered such that there is a greater gap opening at a downstream end than at an upstream end thereof. Preferably, the gap 48 is approximately 380 mm at an upstream end and approximately 400 mm at a downstream end of the sieve 46. As a result, boulders, rocks or the like which are too large to fit through the gap 48 proximate an upstream end of the sieve 46 are directed downwardly toward the larger portion of the gap 48 at the downstream end of the sieve 46 for passage into the funnel 52 and the crusher 54. Each T-shaped bar 50 is held in place between the projecting legs 86 of a pair of spaced L-shaped brackets 88 mounted to the upstream and downstream ends of the sieve 46, as shown particularly in FIGS. 2–4. Each bar 50 is approximately 1.2 meters in length for the second or auxiliary grizzly 44.

As a result of a dredge 10 with the primary grizzly 18 and the auxiliary grizzly 44 on the chute 32, a higher percentage of recoverable material from a load of dredged material is recovered and not discharged. Furthermore, the gate 72 of the second grizzly 44 is advantageously utilized to prevent clay other waste material from the first discharge portion of material from entering the crusher 54 of the second grizzly 44 when it is determined that there is not sufficient recoverable material in the first discharge portion.

The dredge 10, according to this invention, can be constructed and utilized as original equipment. Moreover, an existing gantry-type dredge with a chute may be retrofit to include a second or auxiliary grizzly 44 positioned below the chute 32 and a crusher 54 installed in communication with the second grizzly 44 to achieve the benefits and advantages provided by this invention.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A dredge comprising:

a grab for collecting material;

a first grizzly having a first sieve for straining a first recoverable portion from a first discharge portion of the material deposited thereon, the first discharge portion remaining atop the first sieve;

a discharge mechanism for removing the first discharge portion of material from the first sieve;

a chute to receive the first discharge portion of material from the first sieve;

a second grizzly having a second sieve for straining the first discharge portion of material into a second recoverable portion and a second discharge portion, the second discharge portion remaining atop the second grizzly which is located on the chute; and a crusher in communication with the second grizzly for processing the second recoverable portion of material.

2. The dredge of claim 1 further comprising:

a gate to open and close the second grizzly to permit and inhibit, respectively, the flow of material through the second sieve.

3. The dredge of claim 1 wherein the second sieve further comprises:

a plurality of spaced bars which define a gap between each pair of adjacent bars to allow for the passage of the second recoverable portion of material therethrough.

4. The dredge of claim 3 wherein each gap is tapered such that an upstream end is smaller than a downstream end thereof.

5. The dredge of claim 3 wherein each of the bars is selectively removable.

6. The dredge of claim 1 further comprising:

a funnel to direct the second recoverable portion of material from the second grizzly to the crusher.

7. The dredge of claim 1 wherein the chute is inclined to promote the flow of the first discharge portion of the material from an upstream end of the chute toward a downstream end thereof with the second grizzly positioned therebetween.

8. A dredge comprising:

a grab for collecting material;

a first grizzly having a first sieve for straining a first recoverable portion from a first discharge portion of the material deposited thereon, the first discharge portion remaining atop the first sieve;

a discharge mechanism for removing the first discharge portion of material from the first sieve;

a inclined chute to receive the first discharge portion of material from the first sieve to promote the flow of the first discharge portion of the material from an upstream end of the chute toward a downstream end thereof;

a second grizzly positioned between the upstream and downstream ends of the chute and having a second sieve for straining the first discharge portion of material into a second recoverable portion and a second discharge portion, the second discharge portion remaining atop the second grizzly which is located on the chute, the second sieve including a plurality of spaced and selectively removable bars which define a gap between each pair of adjacent bars to allow for the passage of the second recoverable portion of material therethrough;

a crusher in communication with the second grizzly for processing the second recoverable portion of material;

a funnel to direct the second recoverable portion of material from the second grizzly to the crusher; and a gate to open and close the second grizzly to permit and inhibit, respectively, the flow of material through the second sieve.

9. A method of retrofitting a dredge having a grab and a first grizzly for separating a first recoverable portion of material from a first discharge portion which is subsequently transferred off of the first grizzly and onto a chute, the method comprising:

installing a second grizzly on the chute, the second grizzly being adapted to separate the first discharge portion of material into a second recoverable portion and a second discharge portion of the material; and installing a crusher in communication with the second grizzly to receive the second recoverable portion of material from the second grizzly.

10. The method of claim 9 further comprising:

installing a gate which is movable to and between a closed position and an open position and is adapted to inhibit and permit, respectively, the flow of the second recoverable portion of material through the second grizzly and into the crusher.

11. A method of dredging from a water based site comprising:

collecting a load of dredged material from a waterway;

depositing the dredged material onto a first sieve;

straining a first recoverable portion of the dredged material through the sieve for further processing;

transferring a first discharge portion of the dredged material from the first sieve and onto a chute;

flowing the first discharge portion from an upstream end toward a downstream end of the chute;

straining the first discharge portion through a second sieve located between the upstream and downstream ends of the chute, the straining resulting in a second recoverable portion passing through the second sieve and a second discharge portion;

processing the second recoverable portion in a crusher which is in communication with the second sieve; and discharging the second discharge portion from the chute.

12. The method of claim 11 further comprising:

determining whether the first discharge portion contains any recoverable material;

selectively opening and closing a gate to permit and inhibit, respectively, access to the second sieve depending upon an outcome of the determining step.

13. The method of claim 11 further comprising:

passing the second recoverable portion through a funnel positioned between the second sieve and the crusher.

* * * * *